US005205100A

United States Patent [19]

Lecointre

[11] Patent Number: 5,205,100

[45] Date of Patent: Apr. 27, 1993

[54] BEAM FORMING AN EXPANSION SEAL BETWEEN TWO SIDE-BY-SIDE GRATE LAYERS WITH ALTERNATELY FIXED AND MOBILE BARS

[75] Inventor: Didier Lecointre, Montigny-Le-Bretonneux, France

[73] Assignee: Traitement Industriel Des Residus Urbains (T.I.R.U.), Paris, France

[21] Appl. No.: 717,793

[22] Filed: Jun. 19, 1991

[51] Int. Cl.[5] ..... E04B 1/68

[52] U.S. Cl. ..... 52/573; 126/167; 126/152 B; 403/108; 52/586

[58] Field of Search ..... 52/573, 588, 243.1, 52/393, 396, 586; 126/174, 175, 167, 152 B; 110/268; 403/108, 109, 328, 377

[56] References Cited

U.S. PATENT DOCUMENTS

| | | | |
|---|---|---|---|
| 1,977,496 | 10/1934 | Snyder et al. | 52/393 |
| 2,076,388 | 4/1937 | Venzie | 52/588 |
| 3,418,996 | 12/1968 | Martin | 126/152 |
| 3,699,734 | 10/1972 | Craig et al. | 52/586 |
| 3,778,954 | 12/1973 | Meserole | 52/586 |
| 4,096,809 | 6/1978 | Martin et al. | 110/271 |
| 4,235,172 | 11/1980 | Martin et al. | 110/281 |
| 4,671,190 | 6/1987 | Moreau | 110/281 |

FOREIGN PATENT DOCUMENTS

| | | | |
|---|---|---|---|
| 0004072 | 9/1979 | European Pat. Off. . | |
| 0191254 | 8/1986 | European Pat. Off. . | |
| 1532280 | 7/1968 | France . | |
| 2352250 | 1/1982 | France . | |
| 2574160 | 6/1986 | France . | |
| 709239 | 5/1954 | United Kingdom | 52/243.1 |

*Primary Examiner*—James L. Ridgill, Jr.
*Attorney, Agent, or Firm*—Longacre & White

[57] ABSTRACT

A sealing beam comprises a longitudinal succession of elements disposed between two grate layers made up of a longitudinal succession of alternately fixed and mobile (in longitudinal reciprocation) bars. Each element comprises an I-shaped armature with a web between a lower flange forming a baseplate and an upper flange forming a roof and two U-shaped profile rubbing members with a base bearing on the edge of the corresponding grate layer. Springs passing through holes in the web of the armature urge the rubbing members against the layer edges to compensate for their thermal expansion. The armature and the rubbing members are manufactured by welding to achieve adequate sealing between the rubbing members and the armature.

37 Claims, 2 Drawing Sheets

BEAM FORMING AN EXPANSION SEAL BETWEEN TWO SIDE-BY-SIDE GRATE LAYERS WITH ALTERNATELY FIXED AND MOBILE BARS

BACKGROUND OF THE INVENTION

1. Field of the Invention

The invention concerns a beam designed to compensate thermal expansion of and to seal a gap between two side-by-side grate layers each made up of a longitudinal succession of alternately fixed and mobile (reciprocating) bars, said beam being made up of a longitudinal succession of elongate members with an armature fixed to a grate support frame and with two lateral rubbing members carried by said armature and urged by springs to bear against a respective grate layer edge.

2. Description of the Prior Art

Hearth grates for combustible solids, and in particular for incinerating urban waste, usually comprise a longitudinal succession of bars formed by side-by-side elements which rest with a front surface in front of a back surface of a preceding bar element within the longitudinal succession. The bars are alternately fixed and mobile (in longitudinal reciprocation) to produce a poking effect and to break up the combustible material. These structures are referred to as grates because they incorporate passages for the pressurized combustion-supporting air from underneath the grate to the combustible material. In some types of grate these orifices are formed between two side-by-side elements; in other types cf grate they are formed in the back surface of the elements.

The orifices are designed to procure a regular distribution of the combustion-supporting air over all of the grate layer, for protection against clogging by ash or unburnt material, and in some instances to orient the angle of incidence of the combustion-supporting air into the burning layer with the aim of reducing the emission of flying ash. These combustion-supporting air orifices are executed in extremely diverse ways.

Nevertheless, they all have the common feature of suffering from significant leakage of air between bar elements, which shunts the design air paths and is likely to result in an uneven distribution of the combustion-supporting air and irregular burning. The temperatures to which the grates are exposed cause them to expand and contract; it is therefore necessary to design in clearances when cold sufficient to prevent excessive loading of the hearth walls at high temperature and the risk of parts in relative movement binding.

It must be emphasized that it is not necessary to obtain a total seal, but only to limit accidental leakage to a flowrate that is low in comparison with the normal flowrate through the designed air passages, so that the grate permeability ratio, which is the ratio of the airflow cross-section to the total surface area of the grate, does not fluctuate significantly between different areas of the grate.

It is a simple matter to provide an adequate seal between bar elements in the same transverse row, as they do not move relative to each other. As a result, these elements are frequently fastened together when the grate is assembled to reduce the risk of any element being lifted by the combustible material or a foreign body introduced with the combustible material.

It is therefore at the edges of the grate layer that the risks of creating unwanted leaks are the most serious, all the more so if the clearances between side-by-side elements have been reduced, with the result that displacements due to thermal expansion accumulate at the edges. Expansion compensator seals are therefore required at the edges.

Note that a compensator seal at one edge of a layer is sufficient if the layer is not of excessive width, in which case the compensator seal at the other edge is replaced with a simple abutment surface.

It will be understood that mounting a compensator seal capable of absorbing lateral expansion clearances on a hearth wall lined with refractory bricks raises problems of fixing and of sealing, the steel or cast iron from which the compensator seal is made having a different coefficient of thermal expansion than the bricks.

In large hearths in particular, it is therefore necessary to divide the grate widthwise into layers, with compensator seals between side-by-side layers. This seal, formed by a longitudinal sequence of elongate elements, resembles a beam.

The patent FR-A-1 532 280 describes a beam of this kind, or elastically compressible separator partitions, made up of shell elements urged apart by springs or counterweights which form rubbing members bearing on the grate layer edges. In a particularly simple embodiment, the shells have a U-shaped profile and nest inside each other, sliding on a structure which is joined to the grate layer support structure.

In more complex embodiments the compensator beam includes an armature element fixed to a support structure and two shells which overlap at the top, urged apart by two crossed levers with a common central axis urged downwards by a spring or a counterweight. The effect of the crossover is, in response to a downward load on the axis, to tend to open the levers scissors-fashion and push the shells in parallel motion against edges of the layer.

The patent FR-A-2 352 250 relates to substantially the same embodiment. However, instead of sliding on the armature, the two half-shells are suspended from the ends of almost vertical interior links. This latter embodiment is directed to enabling independent movement of the two half-shells and to reducing the risk of the half-shells binding on the armature. Also, an elongate armature supports several pairs of half-shells, to enable damaged half-shells to be replaced by manipulating only parts of limited weight.

Compensator seals or beams of the prior art as described above have the disadvantage of using cast parts of relatively complicated shape and of comprising relatively complicated mechanisms which are difficult to assemble and which may not be strong enough to resist damage when foreign bodies are introduced into the hearth with the combustible material, which is not a rare occurrence in the incineration of urban waste.

Also, the stated advantages are seen to be relative in the sense that they relate to successive improvements of a common basic design.

An object of the invention is to provide a compensator seal beam as defined above which is simple in design and simple to install, having the minimum of mobile parts or articulations, and which is protected against impact from materials in the layer of combustible material.

SUMMARY OF THE INVENTION

The invention consists in a sealing beam adapted to compensate thermal expansion of and to seal a gap between two side-by-side grate layers each comprising a longitudinal succession of alternately fixed and mobile (reciprocating) bars, said beam being made up of a longitudinal succession of elongate elements with an armature fixed to a grate support frame and with two lateral rubbing members carried by said armature and urged by springs to bear against respective grate layer edges, wherein said armature has an I-shaped profile with a vertical web between a lower flange forming a fixing baseplate and an upper flange forming a roof, the two rubbing members having a U-shaped profile with a vertical base between two branches substantially parallel to said armature flanges and nested within the latter with a small clearance, extending towards said web, said base having a plane exterior surface bearing against the respective grate layer edge and an internal surface between said branches, coil springs passing perpendicularly through holes in said web being compressed between the interior surfaces of said bases of said rubbing members.

In this implementation, the springs act directly to urge the rubbing members against the layer edges; the rubbing members are oriented independently of each other. The upper flange of the armature, which is fixed, protects the rubbing members against forces and impacts from within the layer of combustible material. Also, the simple shapes of the parts enable them to be manufactured by welding, with surface states that are better than if these parts were cast, especially the parts in relative movement. This method of manufacture also means that the metal of each part can be chosen to suit the mechanical or thermal stresses that it is to withstand.

The armature and the rubbing members preferably comprise transverse end plates which on the armature extend from one flange to the other across the entire width of the lower flange and on the rubbing members extend from one branch to the other across the entire length of the branches.

These plates enclose the interior space of the armature and the rubbing members so that each element is sealed autonomously; consequently, there is no need to provide seals between the rubbing members or between the armatures of consecutive elements.

The lower flange of the armature is preferably formed with orifices in the plane of the web discharging into openings formed in the web.

The pressurized combustion-supporting air under the grate has access through these orifices to the interior of the beam element and tends to exit via the interstices between the armature and the rubbing members, so reducing the penetration into the beam element of fine particles from the burning layer.

Secondary features and advantages of the invention will emerge from the following description given by way of example with reference to the appended diagrammatic drawings.

DETAILED DESCRIPTION OF THE INVENTION

Figure 1:
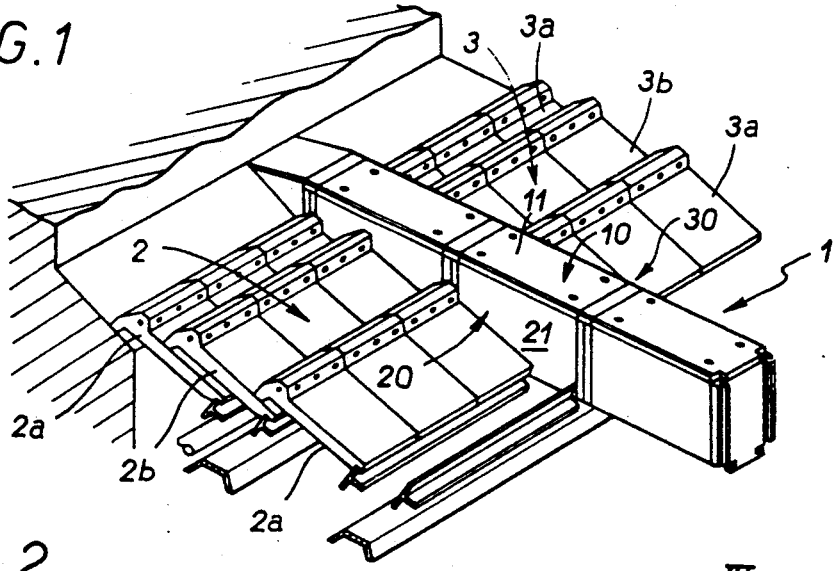
FIG. 1 is a perspective view of part of a sealing beam in accordance with the invention disposed between two side-by-side grate layers.

Referring to FIG. 1, a sealing beam 1 is disposed between two side-by-side grate layers 2 and 3. The grate layers 2 and 3 are each formed by a respective longitudinal succession of bars *2a, 2b, 2a, . . . , 3a, 3b, 3a, . . .*, the lower edge of a front surface of each bar resting on a back surface of a preceding bar, the first bar bearing on a hearth lining plate, and each bar being attached at the rear to a support alternately coupled to the grate frame and to a mobile (in longitudinal reciprocation) chassis. The bars *2a, 3a* are fixed and the bars *2b, 3b* reciprocate longitudinally. Blowing orifices pass through the bar elements and pressurized ducts are disposed underneath the grate layers to feed combustion-supporting air to the hearth through the blowing orifices. A detailed description of a grate of this kind can be found in the patent documents FR-A-2 574 160 and EP-A-0 191 254.

The sealing beam 1 comprises a longitudinal succession of oblong elements 10 which each comprise an armature and lateral rubbing members 20 and 30 respectively urged against the edges of the layers 2 and 3 which bear on their plane exterior surfaces.

Figure 2:
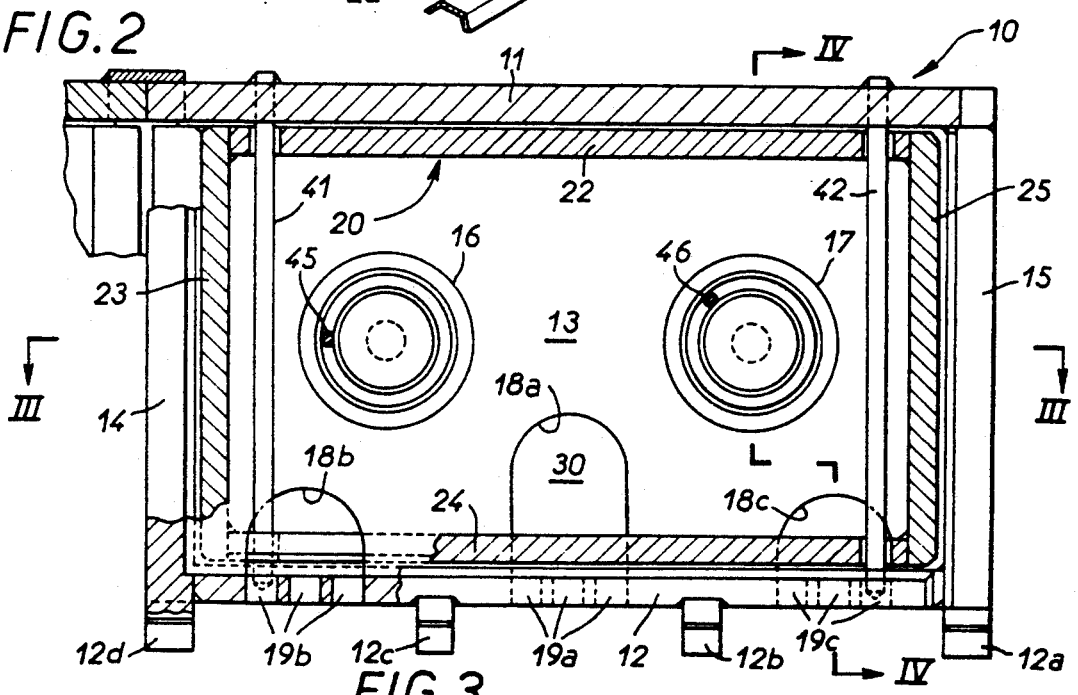
FIG. 2 is a lateral view, partly in cross-section and partly cut away, of a sealing beam element.
Figure 3:
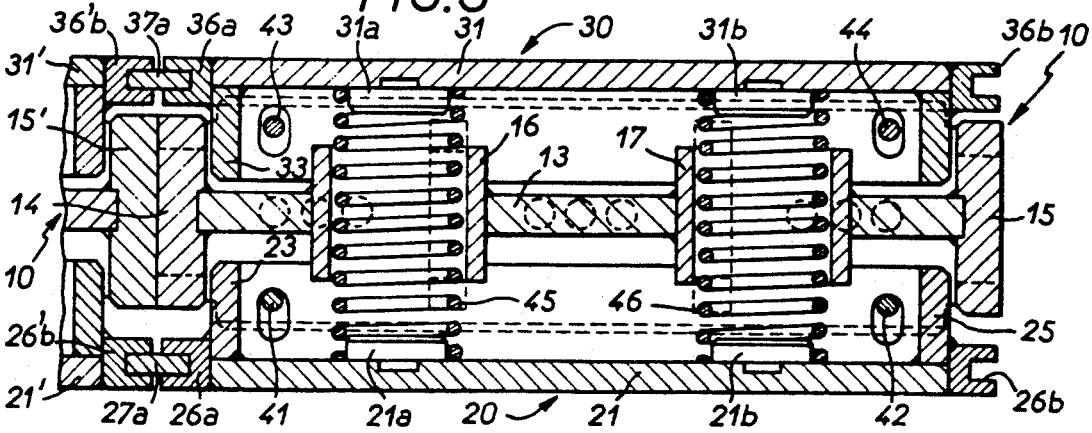
FIG. 3 is a view in cross-section on the plane III—III in FIG. 2.
Figure 4:
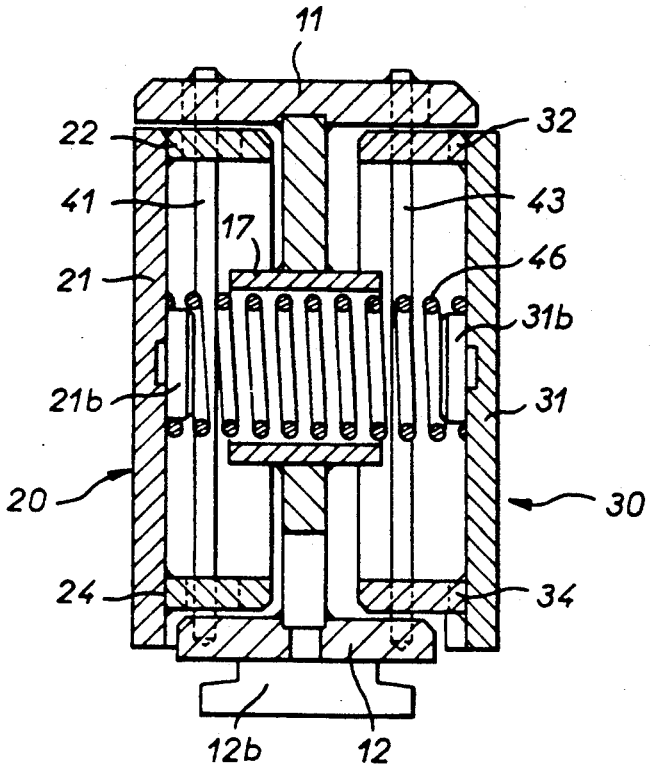
FIG. 4 is a view in cross-section on the plane IV—IV in FIG. 2.

As can be seen in more detail in FIGS. 2, 3 and 4, the sealing beam element comprises an I-shaped armature with a vertical web 13 extending between an upper flange 11 which forms a roof of the element 10 and a lower flange 12 which forms a baseplate for fixing to the grate frame. The element 10 also includes the two rubbing members 20 and 30 which have a U-shaped profile with a vertical base 21, 31 and respective pairs of branches 22, 24 and 32, 34 directed towards the armature web 13 and substantially parallel to the armature flanges 11 and 12 between which they fit with a small clearance. Transverse coil springs 45, 46 pass through circular holes in the web 13 lined with tube sections 16 and 17 and substantially halfway between the flanges 11, 12, to urge the rubbing members 20, 30 apart. The springs 45, 46 are centered in the tube sections 16, 17 by virtue of fitting over circular projections 21*a*, 21*b* and 31*a*, 31*b* on the inside surfaces of the bases 21, 31. This arrangement of the springs ensures that each rubbing member bears flat against the grate layer edge.

The rubbing members 20, 30 are secured to the armature, projecting therefrom to a limited degree, by vertical pins 41, 42, 43, 44 which are inserted in holes in the flanges 11 and 12 and pass through oblong holes in the branches 22, 24, 32, 34.

The armature has at its longitudinal ends two end plates 14 and 15 which extend from the flange 11 to the flange 12 and have a width corresponding to that of the flange 12. The rubbing members have at their longitudinal ends four end plates 23, 33, 25, 35 which extend from one branch to the other.

Note that the armature (web 13, flanges 11, 12 and end plates 14, 15) and the rubbing members 20, 30 (bases 21, 22, branches 22, 24, 32, 34, and end plates 23, 25, 33, 35) are assembled by welding, enabling the use of refractory steel plate stock with smooth and parallel surfaces and with dimensional tolerances closer than can be achieved by casting. The clearances between the rubbing members and the armature can therefore be adjusted appropriately. Also, the rubbing members are nested within the armature on four sides, so that the element 10 is sealed autonomously, in the sense in which the term "seal" must be understood in this context, in other words allowing only leaks which do not affect the combustion-supporting air blowing regime.

The interior volume of the element 10 must communicate with the blowing ducts so that it is at an increased pressure relative to the hearth to prevent flying ash or smoke entering the element. To this end the baseplate flange 12 is provided with transverse bars 12*a*, 12*b*, 12*c*, 12*d* which form a space between the baseplate and a support beam of the grate frame. There are holes 19*a*, 19*b*, 19*c* in the baseplate 12 between these bars, in the plane of the web 13 and discharging into arch-shaped cut-outs 18*a*, 18*b*, 18*c* in the web 13.

As can be seen most clearly in FIG. 3, the element 10' (only the end part of which is shown) is disposed in sequence with the element 10, with its armature rear end plate 15' bearing against the armature front end plate 14 of the element 10. The bases 21 and 31 of the element 10 are extended by morticed bars 26*a*, 26*b*, 36*a*, 36*b*. The bases 21' and 31' of the element 10' also have morticed bars 26'*b*, 36'*b* facing the bars 26*a*, 36*a*. Flat keys 27*a*, 37*a* are inserted into the channels formed by the face-to-face pairs of mortices to couple the rubbing members together.

Figure 5:
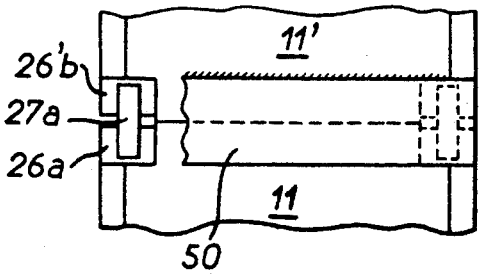
FIG. 5 is a plan view of a joint between two sealing beam elements.
Figure 6:
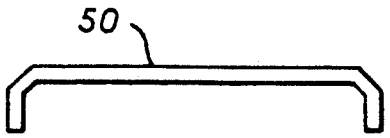
FIG. 6 is a side view of a joint cover plate.

As shown in FIGS. 5 and 6, a joint cover plate 50 formed from flat sheet to the profile of the upper flange 11 of the armature covers the gap between the upper flanges 11 and 11' of the armatures of two successive elements, the joint cover plate being welded to one only of the roof flanges 11 and 11'.

Of course, the invention is not limited to the example described but encompasses all variant executions thereof within the scope of the claims.

In particular, it goes without saying that all or some of the component parts of the beam can be cast, even though the description has referred to parts manufactured by welding.

There is claimed:

1. Sealing beam adapted to compensate thermal expansion of and to seal a gap between two side-by-side grate layers each comprising a longitudinal succession of alternately fixed and mobile (reciprocating) bars, said beam being made up of a longitudinal succession of elongate elements with an armature fixed to a grate support frame and with two lateral rubbing members carried by said armature and urged by springs to bear against respective grate layer edges, wherein said armature has an I-shaped profile with a vertical web between a lower flange forming a fixing baseplate and an upper flange forming a roof, the two rubbing members having a U-shaped profile with a vertical base between two branches substantially parallel to said armature flanges and nested within the latter with a small clearance, extending towards said web, said base having a plane exterior surface bearing against the respective grate layer edge and an internal surface between said branches, coil springs passing perpendicularly through holes in said web being compressed between the interior surfaces of said bases of said rubbing members.

2. Beam according to claim 1 wherein said holes through which said springs pass are circular and lined with tube sections substantially coaxial with said springs.

3. Beam according to claim 1 wherein the interior surfaces of said bases of said rubbing members comprise circular projections on which said coil springs are centered.

4. Beam according to claim 1 wherein pins pass through said armature perpendicularly to said flanges and through oblong holes in said rubbing members parallel to the axes of said springs.

5. Beam according to claim 1 wherein said armature and said rubbing members comprise respective transverse end plates which on said armature extend from one flange to the other over the full width of said lower flange and on said rubbing members extend from one branch to the other over the full length of said branches.

6. Beam according to claim 1 wherein said rubbing members have at their longitudinal ends mortices which extend parallel to the exterior surface of said base and are adapted to receive a key for coupling said rubbing members of successive elements, half of said key being accommodated in each of two face-to-face mortices.

7. Beam according to claim 1 wherein a joint cover plate is disposed over a transverse gap between two adjacent elements in said longitudinal succession thereof, covering said upper flanges of the respective armatures and fixed to one only of said armatures.

8. Beam according to claim 1 comprising holes in said lower bottom flange of said armature in the plane of said web and discharging into cut-outs in said web.

9. Beam according to claim 1 wherein said holes in said web are substantially halfway between said flanges.

10. Beam according to claim 9 wherein a beam element comprises two springs.

11. A sealing beam for compensating for thermal expansion of opposed hearth grate layers, and defining a seal between facing edges of the opposed hearth grate layers, each of the hearth grate layers comprising a longitudinal succession of alternately fixed and mobile grate bars, said sealing beam comprising a longitudinal succession of elongate elements, each of said elongate beam elements comprising an I-shaped structural member having a vertical web extending between a lower flange defining a baseplate for fixing the I-shaped member to a support and an upper flange having an outer surface forming a top side of the sealing beam, and a pair of sealing members, each of the sealing members being of U-shaped configuration and including a vertical web with a substantially planar outer surface and opposed parallel legs extending parallel to the flanges of the I-shaped structural member, the legs of the sealing member being disposed immediately inwardly of the flanges of the I-shaped structural member, slight clearance being formed between free edges of the legs of the U-shaped members and the web of the I-shaped member, coil springs extending through openings in I-shaped member web and bearing respectively on inner surfaces of the webs of the U-shaped members to urge said sealing members into contact with the respective facing edges of the hearth grate layers.

12. Beam according to claim 11 wherein said openings in said web of the I-shaped member are defined by tube sections disposed substantially coaxially with said springs.

13. Beam according to claim 11 wherein the interior surfaces of said webs of said U-shaped sealing members comprise circular projections on which said coil springs are centered.

14. Beam according to claim 11 further comprising pins extending perpendicularly to said flanges of said I-shaped member and through oblong holes in the legs of said sealing members, major axes of the oblong holes being parallel to the axes of said springs, said pins limiting displacement of the sealing members relative to the I-shaped member.

15. Beam according to claim 11 wherein said I-shaped member and said sealing members have respective transverse end plates, the transverse end plates of the I-shaped member extending from one flange to the other over thee full width of said lower flange and the transverse end plates on the U-shaped members extending from one leg to the other over the full length of said legs.

16. Beam according to claim 11 wherein said sealing members have at their longitudinal ends mortices which extend parallel to the exterior surface of the web of the U-shaped member and are adapted to receive a key for coupling said sealing members of successive elements, half of said key being accommodated in each of two face-to-face mortices.

17. Beam according to claim 11 wherein a joint cover plate is disposed over a transverse gap between two adjacent elements in said longitudinal succession thereof, said joint cover covering said upper flanges of the respective I-shaped members and fixed to one only of said I-shaped members.

18. Beam according to claim 11 further comprising holes in said lower bottom flange of said I-shaped member lying substantially in the plane of the web thereof and extending into cut-outs in said web.

19. Beam according to claim 11 wherein the beam is rectangular in transverse cross section.

20. Beam according to claim 11 wherein said U-shaped members are substantially entirely accommodated inside the confine of the I-shaped member.

21. Beam according to claim 11 wherein the sealing members and I-shaped member are of welded metal plate construction.

22. Beam according to claim 11 wherein said openings in said web are substantially halfway between the respective flanges of the I-shaped member.

23. Beam according to claim 22 wherein there are less than three and more than one coil spring.

24. A hearth grate comprising at least two side-by-side grate layers, each of the grate layers comprising a longitudinal succession of alternately fixed and reciprocating grate bars, and a sealing beam for compensating for thermal expansion of opposed hearth grate layers, and defining a seal between facing edges of the opposed hearth grate layers, said sealing beam comprising a longitudinal succession of elongated elements, each of said elongated beam elements comprising an I-shaped structural member having a vertical web extending between a lower flange defining a baseplate for fixing the I-shaped member and an upper flange forming a top side of the sealing beam, and a pair of sealing members, each of the sealing members being of U-shaped configuration and including a vertical web having a generally planar outer surface and opposed parallel legs extending parallel to the flanges of the I-shaped structural member, the legs of the sealing member being disposed immediately inwardly of the flanges of the I-shaped structural member, said U-shaped members being mounted for limited movement relative to the I-shaped member, coil springs extending through openings in I-shaped member web and bearing respectively on inner surfaces of the webs of the U-shaped members to urge said sealing members into contact with the respective facing edges of the hearth grate layers.

25. Hearth grate according to claim 24 wherein said openings inn said web of the I-shaped member are defined by tube sections substantially coaxial with said springs.

26. Hearth grate according to claim 24 wherein the interior surfaces of said webs of said U-shaped sealing members comprise circular projections on which said coil springs are centered.

27. Hearth grate according to claim 24 further comprising guiding pins extending perpendicularly to said flanges of said I-shaped member and through oblong holes in the flanges of said sealing members, major axes of the oblong holes being parallel to the axes of said springs.

28. Hearth grate according to claim 24 wherein said I-shaped member and said sealing members have respective transverse end plates, the transverse end plates of the I-shaped member extending from one flange to the other over the full width of said lower flange and the transverse end plates on the U-shaped members extending from one leg to the other over the full length of said legs.

29. Hearth grate according to claim 24 wherein said sealing members have at their longitudinal ends mortices which extend parallel to the outer surfaces of the webs of the U-shaped members and are adapted to receive a key for coupling said sealing members of successive elements, half of said key being accommodated in each of two face-to-face mortices.

30. Hearth grate according to claim 24 wherein a joint cover plate is disposed over a transverse gap between two adjacent elements in said longitudinal succession thereof, said joint cover covering said upper flanges of the respective I-shaped members and fixed to one only of said I-shaped members.

31. Hearth grate according to claim 24 comprising holes in said lower bottom flange of said I-shaped member lying substantially in the plane of the web thereof and extending into cut-outs in said web.

32. Hearth grate according to claim 24 wherein the beam is rectangular in transverse cross section.

33. Hearth grate according to claim 24 wherein said U-shaped members are substantially entirely accommodated inside the confines of the I-shaped members.

34. Hearth grate according to claim 24 wherein the sealing members and I-shaped member are of welded metal plate construction.

35. A hearth grate for combustion of solids comprising at least tow side-by-side grate layers, each of the grate layers comprising a longitudinal succession of fixed and mobile grate bars, said grate bars incorporating passages for pressurized combustion supporting air, and a sealing beam for compensating for thermal expansion of opposed hearth grate layers, and defining a seal between facing edges of the opposed hearth grate layers, said sealing beam comprising a longitudinal succession of elongated elements, each of said elongated beam elements comprising an I-shaped structural member having a vertical web extending between a lower flange defining a baseplate for fixing the I-shaped member and an upper flange forming a top side of the sealing beam, and a pair of sealing members, each of the sealing members being of U-shaped configuration and including a vertical web and opposed parallel legs extending parallel to the fianges of the I-shaped structural member, the legs of the sealing member being disposed immediately inwardly of the flanges of the I-shaped structural member, said U-shaped members being mounted for limited movement relative to the I-shaped member, coil springs extending through openings in I-shaped web and bearing respectively on inner surfaces of the webs of the U-shaped members to urge said sealing members into contact with the respective facing edges of the hearth grate layers thereby limiting the flow of pressurized combustion supporting air escaping between the opposed grate layers.

36. Hearth grate according to claim 24 wherein said openings in said web are substantially halfway between the respective flanges of the I-shaped member.

37. Hearth grate according to claim 36 wherein there are less than three and more than one coil spring.

* * * * *